US009371491B2

(12) United States Patent
Yuan et al.

(10) Patent No.: US 9,371,491 B2
(45) Date of Patent: Jun. 21, 2016

(54) BITUMEN RECOVERY FROM OIL SANDS TAILINGS

(71) Applicant: SYNCRUDE CANADA LTD. in trust for the owners of the Syncrude Project, as such owners exist now and in the future, Fort McMurray (CA)

(72) Inventors: Simon Yuan, Edmonton (CA); Owen Neiman, Fort McMurray (CA); Jonathan Spence, Edmonton (CA); Brent Hilscher, Surrey (CA); Ron Siman, Edmonton (CA)

(73) Assignee: SYNCRUDE CANADA LTD., Fort McMurray (CA), in trust for the owners of the Syncrude Project as such owners exist now and in the future ( * ) Notice: Subject to any disclaimer, the term of this patent is extended or adjusted under 35 U.S.C. 154(b) by 167 days.

(21) Appl. No.: 14/496,857

(22) Filed: Sep. 25, 2014

(65) Prior Publication Data

US 2016/0090536 A1 Mar. 31, 2016

(51) Int. Cl.
*C10G 1/04* (2006.01)

(52) U.S. Cl.
CPC ..... *C10G 1/047* (2013.01)

(58) Field of Classification Search
CPC ..... C10G 1/047
See application file for complete search history.

(56) References Cited

U.S. PATENT DOCUMENTS

| | | | | | |
|---|---|---|---|---|---|
| 4,111,789 | A * | 9/1978 | Porteous | C10G 1/047 | 208/391 |
| 4,425,227 | A * | 1/1984 | Smith | B03B 9/02 | 208/390 |
| 4,851,123 | A * | 7/1989 | Mishra | B01D 17/00 | 210/609 |
| 5,006,239 | A * | 4/1991 | Mishra | B01D 17/00 | 210/181 |
| 2009/0020458 | A1* | 1/2009 | Bozak | B01D 17/0205 | 208/390 |
| 2013/0056395 | A1* | 3/2013 | Pierre, Jr. | C10G 1/002 | 208/390 |
| 2013/0206702 | A1* | 8/2013 | Lin | C02F 1/5245 | 210/728 |
| 2014/0346088 | A1* | 11/2014 | Yuan | C10G 1/045 | 208/390 |

OTHER PUBLICATIONS

Thomas, T., et al. Recovery of Hydrocarbons From Mature Fine Tailings of Oil Sands Extraction. Proceedings of the 2nd International Oil Sands Tailings Conference. 2010. pp. 141-148. Edmonton, Alberta, Canada.

* cited by examiner

*Primary Examiner* — Randy Boyer
(74) *Attorney, Agent, or Firm* — Bennett Jones LLP

(57) ABSTRACT

There is provided a method including: combining storage pond tailings with a heated tailings stream to form a tailings mixture, the storage pond tailings having a temperature and a solids content and the tailings mixture having a resulting solids content less than the solids content of the storage pond tailings; and treating the tailings mixture to recover bitumen therefrom.

29 Claims, 11 Drawing Sheets

BITUMEN RECOVERY FROM OIL SANDS TAILINGS

FIELD OF THE INVENTION

The present invention relates to a process for removing bitumen from oil sands tailings, and in particular, a process for bitumen recovery from tailings from storage ponds.

BACKGROUND OF THE INVENTION

Oil sand generally comprises water-wet sand grains held together by a matrix of viscous heavy oil or bitumen. Bitumen is a complex and viscous mixture of large or heavy hydrocarbon molecules that contain a significant amount of sulfur, nitrogen and oxygen. The extraction of bitumen from sand using hot water processes yields large volumes of fine tailings composed of fine silts, clays, residual bitumen and water. Mineral fractions with a particle diameter less than 44 microns are referred to as "fines". These fines are typically clay mineral suspensions, predominantly kaolinite and illite.

The fine tailings suspension is typically 85% water and 15% fine particles by mass. Dewatering of fine tailings occurs very slowly.

Generally, the fine tailings are discharged into a storage pond for settling and dewatering. When first discharged in the pond, the very low solids content material is referred to as thin fine tailings. After a few years, the tailings separate into an upper layer of water, a settled layer of coarse solids and a fluid fine tailings (FFT) layer between the upper water layer and the bottom layer of settled coarse solids. The fluid fine tailings generally have a solids content of about 10-45 wt % and behave as a fluid-like colloidal material.

A substantial amount of bitumen remains in the tailings stream from oil sand extraction. For example, there is approximately 20 MBbl of bitumen per 100 $Mm^3$ of fluid fine tailings.

The tailings bitumen represents a large loss given the commercial value of this potentially useable hydrocarbon. Furthermore, the tailings bitumen interferes with tailings operations, including reducing the efficiency of tailings treatments. In addition, tailings bitumen may represent an environmental risk by accumulation in the storage ponds.

Accordingly, there is a need for a method to recover bitumen from tailings in the storage ponds.

SUMMARY OF THE INVENTION

The current application is directed to a method to recover bitumen from tailings in the storage ponds, which will be referred to herein as storage pond tailings.

In accordance with a broad aspect of the present invention, there is provided a method including:

combining storage pond tailings with a heated tailings stream to form a tailings mixture, the storage pond tailings having a temperature and a solids content and the tailings mixture having a resulting solids content less than the solids content of the storage pond tailings; and treating the tailings mixture to recover bitumen therefrom.

BRIEF DESCRIPTION OF THE DRAWINGS

Referring to the drawings wherein like reference numerals indicate similar components and steps throughout the several views, several aspects of the present invention are illustrated by way of example, and not by way of limitation, in detail in the figures, wherein.

DETAILED DESCRIPTION OF THE PREFERRED EMBODIMENTS

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practiced without these specific details.

The current application is directed to a method for recovering bitumen from storage pond tailings. In the method, a tailings mixture is formed by combining storage pond tailings with a heated tailings stream and the tailings mixture has a solids content less than those of the storage pond tailings. The tailings mixture is then treated to recover bitumen from the tailings mixture. In so doing, bitumen may be recovered from the storage pond. In addition, a treated tailings stream may be generated, which is more suitable for further handling than storage pond tailings.

Storage pond tailings generally have a solids content of about 10 to 45 wt %. The storage pond tailings may be, for example, fluid fine tailings. Fluid fine tailings can have a solids content of about 10 to 45 wt % but generally the solids content is in the range of about 30 to 40 wt %.

Storage pond tailings are obtained from a tailings storage pond, also called a tailings pond, settling pond, settling basin, etc. These ponds are generally in an outdoor setting and, thus, are exposed to normal outdoor conditions. Thus, storage pond tailings, including fluid fine tailings, can have a temperature of about 1 to 25° C., but most often are at about 5 to 20° C.

Storage pond tailings may be obtained by pumping or otherwise drawing tailings from a storage pond. After a residence time in a storage pond, storage pond tailings may separate into an upper water layer, an FFT layer and a bottom layer of settled, coarse solids. In one embodiment, the storage pond tailings are predominantly FFT. The FFT may be removed from between the water layer and the solids layer, for example, via a dredge or floating barge having a submersible pump.

Figure 1:
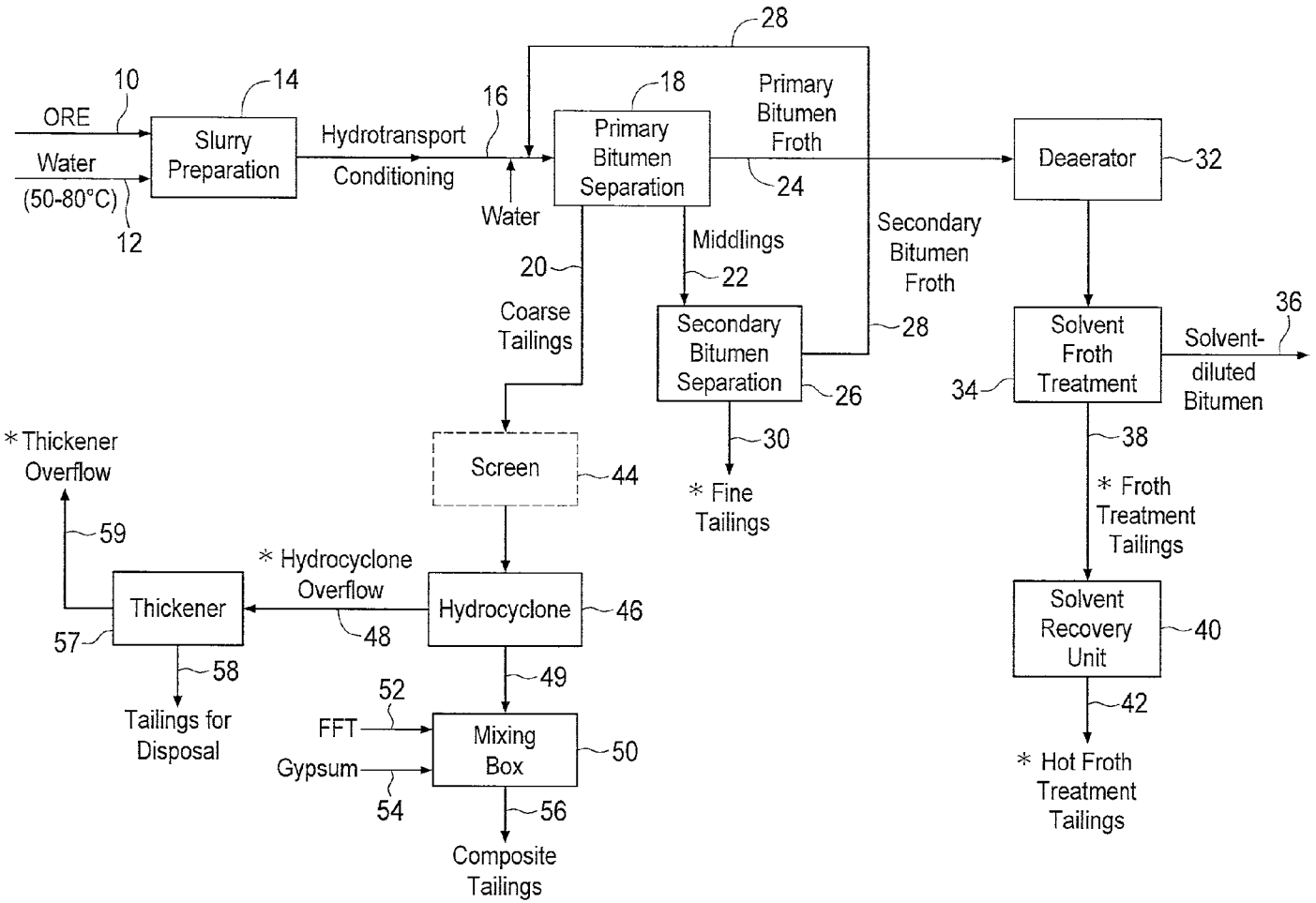
FIG. 1 is a process flow diagram of a typical hot/warm water based oil sand extraction practice.

Heated tailings are derived from various stages of oil sand processing. FIG. 1 is a flow diagram of a typical hot/warm water oil sand extraction process showing the various tailings streams that are produced. These tailings streams useful in the present invention are indicated in FIG. 1 with an asterisk (*). As-mined or pre-crushed oil sand ore 10 is first mixed with slurry water 12 having a temperature generally around 50-80° C. (and, optionally, caustic) in a slurry preparation unit 14 such as a tumbler, mix box, etc. and the resultant oil sand slurry is transported through a hydrotransport pipeline 16 with air injection for conditioning prior to bitumen separation. The conditioned slurry is then optionally diluted and subjected to gravity separation in a primary separation vessel 18, where three layers are formed: coarse tailings 20, middlings 22 and bitumen froth 24 (commonly referred to as primary bitumen froth). The middlings 22 are further treated in a secondary recovery unit 26, such as flotation cells or the like, where further bitumen froth 28 (commonly referred to as secondary bitumen froth) is recovered and a finer tailings stream 30 is produced. The secondary bitumen froth 28 may either be combined with primary bitumen froth 24 for further treatment or may be recycled back to the primary separation vessel 18. The finer tailings stream 30 (i.e., the secondary separation/flotation tailings) generally will have a temperature ranging from about 35° C. to about 50° C. The solids contents and sand to fine ratios (SFR) in the finer tailings stream 30 typically contain 10-40% solids depending upon the amount of dilution water added. The finer tailings steam 30 is a tailings stream useful in the present invention.

Bitumen froth produced during bitumen separation generally comprises about 60 wt % bitumen, about 30 wt % water and about 10 wt % solids and, thus, needs to be further cleaned prior to upgrading. Generally, the bitumen froth is first deaerated in a deaerator 32, for example, a steam deaerator, and then subjected to froth treatment 34 using a hydrocarbon solvent such as naphtha or paraffin. Solvent-diluted froth (often referred to as dilfroth) is then subjected to at least one stage of gravity- or centrifuge-based separation to produce solvent-diluted bitumen 36 (often referred to as dilbit), having reduced solids and water. The tailings that are produced during froth treatment are generally referred to as froth treatment tailings 38 and have a solids content typically about 20-25% and a temperature of about 80° C. The froth treatment tailings 38 is another tailings stream useful in the present invention. However, since the froth treatment tailings 38 still have a considerable amount of solvent associated with them, the froth treatment tailings 38 are further treated in a solvent recovery unit 40 where the solvent is stripped with steam and hot froth treatment tailings 42 are produced. Generally, the hot froth treatment tailings 42 that are produced after hydrocarbon solvent removal are the most useful tailings stream in the present invention.

The coarse tailings 20 can also be further treated. In one embodiment, coarse tailings 20 can be used to form composite tailings with fluid fine tailings (FFT). In particular, coarse tailings 20 produced from primary bitumen separation 18 may be optionally first screened in a rotating, stationary or vibrating screen 44 to remove large lumps and the screened tailings are then subjected to separation in a plurality of hydrocyclones 46. The hydrocyclone overflow 48 is another tailings stream useful in the present invention. The hydrocyclone overflow 48 typically has a temperature of about 35° C. to about 50° C. The solids content in the hydrocyclone overflow 48 is typically in the range of 2-25% solids, depending on the feed properties and the hydrocyclone operation conditions. The hydrocyclone underflow 49 is then mixed in mix box 50 with fluid fine tailings 52 from tailings ponds and gypsum 54 to form non-segregating composite tailings 56.

In another embodiment, hydrocyclone overflow 48 is further treated in at least one thickener 58 to produce thickened tailings 58 for disposal and thickener overflow 59, which is another tailings stream useful in the present invention.

The heated tailings useful in the present invention are selected to have a solids content less than that of the storage pond tailings, such that when combined, the combination of heated tailings and storage pond tailings has a dilution greater than that of the storage pond tailings. RCW may be added to the combined tailings to achieve an optimal flotation feed density if necessary.

In addition, the heated tailings have a temperature greater than the temperature of the storage pond tailings to be employed. As such, the combination of heated tailings and storage pond tailings has a temperature greater than that of the storage pond tailings.

To facilitate operations, the heated tailings may be a tailings stream that is already heated, rather than heated solely for this purpose. For example, as noted above, tailings may be used from a primary bitumen extraction process, which is the process through which mined oil sands ore is first treated. In one embodiment, for example, the heated tailings may be fine tailings 30, froth treatment tailings 38, hot froth treatment tailings 42 and/or hydrocyclone overflow 48.

As noted above, the most useful source of heated tailings is the hot froth treatment tailings 42. These tailings 42 may contain solids and water, likely some amount of residual bitumen and possibly traces of one or more additives such as solvents from the froth treatment process. Generally, the hot froth treatment tailings include solids of less than 25% and generally less than 20%.

Also, the hot froth treatment tailings are generally much warmer than storage pond tailings, for example, having a temperature of about 80 to 100° C. and generally 85 to 95° C.

While recovery of tailings bitumen from storage pond tailings has previously been so difficult as to be uneconomic, it has been determined that combining the storage pond tailings with a heated tailings stream may dilute and heat the resultant tailings mixture such that recovery of the tailings bitumen from storage pond tailings may become economically viable. The combined tailings mixture has a resulting mixture temperature that is greater than the temperature of the storage pond tailings and a resulting solids content that is less than the solids content of the storage pond tailings. In one embodiment, for example, the tailings mixture includes a temperature of greater than 20° C. and possibly greater than 30° C. and a solids content of less than 20% and possibly of less than the gel point for the storage pond tailings, which for fluid fine tailings is less than about 13%. In general, it was discovered that the more dilute the FFT feed, the easier it is to float the bitumen therein.

Tailings mixtures of the present invention can be treated to remove bitumen. The treatments may include various processes including, for example, flotation, froth cleaning and froth treatment. The recovery of bitumen from the tailings mixture is much better than the recovery of bitumen from storage pond tailings alone, without addition of heated tailings.

In addition to bitumen, the method generates a treated tailings stream. The treated tailings stream at least contains less bitumen and is, therefore, more suited to further handling. For example, the treated tailings stream may be more suitable for disposal than the storage pond tailings. The treated tailings stream, having some or all of the bitumen removed, may be receptive to further treatments.

Because the heated tailings may also contain some bitumen, the present method provides an efficiency by combining treatments for bitumen recovery for storage pond tailings and heated tailings coming out of the primary, first stage oil sand processes. This highly synergistic process for bitumen recovery from FFT takes the advantage of the heat from the heated tailings and the dilution from the water in the heated tailings by combining bitumen incentive from two waste streams in one process. Thus, two separate processing facilities would not be required.

Figure 2:
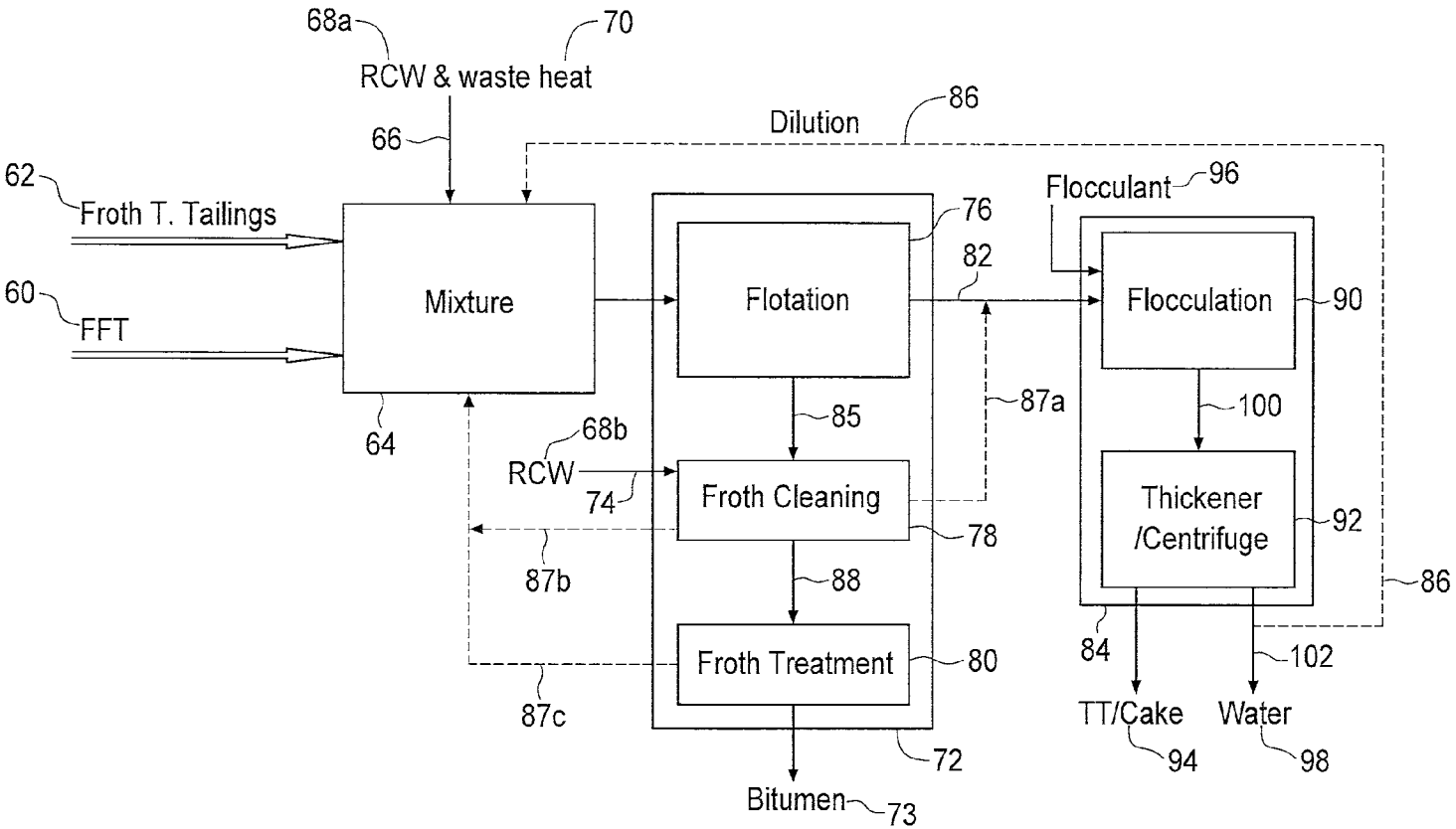
FIG. 2 is a schematic process flow diagram of an embodiment of the present invention for recovering bitumen from oil sands tailings.

One embodiment of the invention is shown in FIG. 2. The illustrated method is for removing bitumen from storage pond tailings, here in the form of fluid fine tailings (FFT) 60. FFT 60 can have a solids content of about 10 to 45 wt % but generally the solids content is in the range of about 30 to 40 wt %. Being from an outdoor site and having had a long residence time in a storage pond, FFT may have an ambient temperature of about 1 to 25° C., but most often are at about 5 to 20° C.

The FFT is combined with a heated tailings stream, here shown as hot froth treatment tailings 62. Hot froth treatment tailings are obtained from the treatment of bitumen froth using any suitable froth treatment process, including without limitation, processes using a froth treatment diluent such as naphtha or paraffin, a gravity settler such as an inclined plate settler, enhanced gravity separation apparatus such as a scroll centrifuge and/or solvent recovery unit. Preferably, hot froth treatment tailings have been treated in a diluent/solvent recovery unit to remove a large portion of the solvent remaining with the tailings.

Hot froth treatment tailings 62 are generally at a temperature of about 80 to 100° C. and generally include 5 to 20% solids by weight and 1 to 12% bitumen by weight in water. Hot froth treatment tailings 62 may be further comprised of an amount of a froth treatment diluent which is present as a result of separating the froth treatment tailings from the bitumen froth. Where the heated tailings include a froth treatment diluent, the froth treatment diluent may be comprised of a naphthenic type diluent and/or a paraffinic type diluent.

Preferably, however, the heated tailings contain little or no froth treatment diluent, because the froth treatment diluent has been recovered from the hot froth treatment tailings in a tailings solvent recovery unit process or a similar process. Such a process increases the temperature of the tailings considerably.

In one embodiment, hot froth treatment tailings 62 contain, on average, about 17% solids, 3% bitumen, 80% water and a small amount, for example about 0.2%, of naphtha by wt.

The FFT and hot froth treatment tailings are combined to form a tailings mixture 64. The tailings mixture is selected to have a temperature greater than the temperature of the storage pond tailings and a solids content less than the solids content of the storage pond tailings. Thus, the FFT is heated and diluted by forming the tailings mixture.

The FFT and hot froth treatment tailings are combined in various ratios. Generally, to treat useful volumes of FFT, the ratio is less than 3:1 hot froth tailings to FFT. When FFT is combined with hot froth tailings at ratios of less than 1:1, the high fines content of FFT tends to adversely affect bitumen recovery and froth quality. Thus, ratios of 1.5:1 to 2.5:1 (heated tailings to FFT) are most useful.

Tailings mixture 64 may, for example, have a temperature of greater than 20° C., for example between 30° C. and 60° C.

Tailings mixture 64 may, for example, also have a solids content of less than 20%, for example 5 to 20% wt. In one embodiment, it is useful to bring tailings mixture to a dilution less than the gel point of the fluid fine tailings, which is generally less than 13% solids by weight.

If desired, tailings mixture 64 may be further diluted and/or heated by addition 66 of recycle water (RCW) 68*a* and/or heat such as waste heat 70 to achieve the desired conditions of temperature and dilution. Waste heat 70 may include hot water from cooling towers, such as upgrading cooling towers, or other waste heat streams.

In one embodiment, where it is difficult to achieve desired dilutions (<13%) with just the heated tailings, water such as recycle water 68*a* may be added to dilute tailings mixture 64. However, the lower temperature of recycle water, which is generally close to the temperature of storage pond tailings (i.e. 5 to 20° C.), may drive down the temperature below desirable levels. As such, if recycle water 68*a* is added to tailings mixture 64, generally the recycle water and/or the tailings mixture are heated.

The tailings mixture may be treated 72 to recover bitumen 73 therefrom. During this treatment process, it may be useful to maintain the appropriate mixture temperature and dilution. In one embodiment, for example, recycle water (RCW) 68*b* may be added 74.

Bitumen recovery treatment 72 may include conditioning, solvent extraction, etc. to obtain bitumen 73. In the illustrated embodiment, for example, bitumen recovery treatment 72 includes flotation 76, froth cleaning 78 and froth treatment 80 to obtain bitumen 73.

Flotation 76 is an operation in which components of a mixture are separated by passing a gas through the mixture so that the gas causes one or more components of the mixture to float to the top of the mixture and form a froth. Froth flotation may be performed using flotation cells or tanks, flotation columns or any other suitable froth flotation apparatus, which may or may not include agitators or mixers, and froth flotation may include the use of flotation aids, including without limitation, surfactants and frothing agents.

For example, flotation 76 may include conditioning the tailings mixture by aeration, agitation, etc. in order to facilitate separation of the tailings bitumen from the solids. Conditioning may include agitating the tailings mixture, with this kinetic energy aerating the bitumen and causing it to attach to air bubbles to float as froth 85 and separate from the solids and water, which may be separated as tailings 82. Flotation 76 may agitate tailings mixture 64 in any suitable manner, including, without limitation, by stirring and/or by mixing including by piping or gas injection. In particular, subjecting the tailings mixture to froth flotation may be performed using any suitable froth flotation apparatus.

Flotation 76 concentrates the bitumen in the froth 85. The froth may be collected as an overflow product. When separated from the underflow of tailings 82, froth 85 may be subjected to froth cleaning 78.

Froth cleaning 78 produces dilute tailings 87*a*, including mostly water and some solids, and an improved froth 88 including the bitumen. Froth cleaning 78 may subject froth 85 to various processes including any or all of dewatering, gravity settling, solvent extraction, etc. For example, froth cleaning 78 may include the addition of an amount of a hydrocarbon solvent to incoming froth 85 for solvent extraction.

Solvent extraction is an operation in which components of a mixture are separated by adding to the mixture a suitable liquid solvent, here a hydrocarbon solvent, which dissolves or dilutes one or more components of the mixture, thereby facilitating separation of components of the mixture. Solvent extraction apparatus may be employed such as including gravity settlers (including without limitation, gravity settling vessels, inclined plate separators, and rotary disc contactors) and enhanced gravity separators (including without limitation, centrifuges and hydrocyclones).

The hydrocarbon solvent is a substance containing one or more hydrocarbon compounds and/or substituted hydrocarbon compounds which is suitable for use for diluting bitumen. Generally, the hydrocarbon solvent may include any suitable naphthenic type diluent or any suitable paraffinic type diluent.

A naphthenic type diluent is a solvent that includes a sufficient amount of one or more aromatic compounds so that the solvent exhibits the properties of a naphthenic type diluent as recognized in the art, as distinguished from a paraffinic type diluent. In this document, a naphthenic type diluent may therefore include solvents such as naphtha and toluene.

A paraffinic type diluent is a solvent that includes a sufficient amount of one or more relatively short-chain aliphatic compounds (such as, for example, C5 to C8 aliphatic compounds) so that the solvent exhibits the properties of a paraffinic type diluent as recognized in the art, as distinguished from a naphthenic type diluent. In this document, a paraffinic type diluent may therefore include solvents such as natural gas condensate.

If bitumen froth quality is poor, recycle water (RCW) 68*b* may be added during froth cleaning to dilute the froth to facilitate cleaning. This is especially true if froth cleaning is conducted using a flotation column. If solvent extraction is employed for froth cleaning, it may not be necessary to dilute the froth with further water.

Froth 88 is then treated 80 to concentrate and recover the bitumen 73. Treatment 80 may include for example clarification, concentration and dewatering such as by solvent recovery, centrifugation, etc.

The process removes bitumen from the storage pond tailings. The bitumen recovery may be greater than 15% and in some cases recovery may be greater than 50%.

Tailings from bitumen recovery treatment 72, for example tailings 82 from flotation 76, may be passed for disposal 84. Dilute tailings 87*a* from later processes of bitumen recovery may be disposed of, along with tailings 82, and/or the dilute tailings may be returned 87*b* for dilution of the tailings mixture 64. Another source of dilution water may be the tailings 87*c* from froth treatment.

Tailings 82, which may contain some tailings 87*a*, may be disposed of in any of various ways, such as by returning to a tailings storage pond. However, due to the effectiveness of the above-noted process, the tailings contain only a minor amount of bitumen and may be suitable for treatment to concentrate solids. For example, tailings 82 may be subjected to dewatering treatments such as may include flocculation 90 and thickening or centrifugation 92, to generate thickened tailings or centrifuge cake 94 and water 98. In this process, the tailings are treated with flocculant 96 prior to dewatering by centrifugation 92 to aggregate the solids and to recover the water.

In one embodiment, for example, flocculant 96 is introduced into the in-line flow or directly to a mixer to mix with tailings 82. As used herein, the term "flocculant" refers to a reagent which bridges the neutralized or coagulated particles into larger agglomerates, resulting in more efficient settling. Flocculants useful in the present invention are generally anionic, nonionic, cationic or amphoteric polymers, which may be naturally occurring or synthetic, having relatively high molecular weights. Preferably, the polymeric flocculants are characterized by molecular weights ranging between about 1,000 kD to about 50,000 kD. Suitable natural polymeric flocculants may be polysaccharides such as dextran, starch or guar gum. Suitable synthetic polymeric flocculants include, but are not limited to, charged or uncharged polyacrylamides, for example, a high molecular weight polyacrylamide-sodium polyacrylate co-polymer.

Other useful polymeric flocculants can be made by the polymerization of (meth)acrylamide, N-vinyl pyrrolidone, N-vinyl formamide, N,N dimethylacrylamide, N-vinyl acetamide, N-vinylpyridine, N-vinylimidazole, isopropyl acrylamide and polyethylene glycol methacrylate, and one or more anionic monomer(s) such as acrylic acid, methacrylic acid, 2-acrylamido-2-methylpropane sulphonic acid (ATBS) and salts thereof, or one or more cationic monomer(s) such as dimethylaminoethyl acrylate (ADAME), dimethylaminoethyl methacrylate (MADAME), dimethydiallylammonium chloride (DADMAC), acrylamido propyltrimethyl ammonium chloride (APTAC) and/or methacrylamido propyltrimethyl ammonium chloride (MAPTAC).

In one embodiment, the flocculant 96 comprises an aqueous solution of an anionic polyacrylamide. The anionic polyacrylamide preferably has a relatively high molecular weight (about 10,000 kD or higher) and medium charge density (about 20-35% anionicity), for example, a high molecular weight polyacrylamide-sodium polyacrylate co-polymer. The preferred flocculant may be selected according to the tailings 82 and process conditions.

The flocculant 96 is supplied from a flocculant make up system for preparing, hydrating and dosing of the flocculant. Flocculant make-up systems are well known in the art, and typically include a polymer preparation skid, one or more storage tanks, and a dosing pump. The dosage of flocculant 96 is controlled by a metering pump. In one embodiment, the dosage of flocculant 96 ranges from about 400 grams to about 1,500 grams per tonne of solids in the FFT. In one embodiment, the flocculant is in the form of a 0.4% solution.

When the flocculent 96 contacts tailings 82, it starts to react to form flocs formed of multiple chain structures and solids. Tailings 82 and flocculant 96 are combined at least to some degree within a mixer. Since flocculated material is shear-sensitive, it must be mixed in a manner so as to avoid over-shearing. Over-shearing is a condition in which additional energy has been input into the flocculated tailings, resulting in release and re-suspension of the fines within the water. Suitable mixers include, but are not limited to, T mixers, static mixers, dynamic mixers, and continuous-flow stirred-tank reactors. In one embodiment, the mixer is a T mixer positioned before the feed tube of the centrifuge employed for centrifugation 92. In one embodiment, flocculation may be achieved by introducing flocculant directly to tailings 82 in a feed line to the centrifuge or thickener.

Flocculation 90 produces a suitable feed 100 which can be dewatered and thickened by centrifugation 92. The feed 100 is transferred to the centrifuge for dewatering. In one embodiment, a centrifuge useful in centrifugation is a solid bowl decanter centrifuge. Solid bowl decanter centrifuges are capable of dewatering materials which are too fine for effective dewatering by screen bowl centrifuges. Extraction of centrate water 98 occurs in the cylindrical part of the bowl, while dewatering of solids by compression of the centrifuge cake 94 takes place in the conical part of the bowl. Separation of the water 98 and centrifuge cake 94 using a solid bowl decanter centrifuge may be optimally achieved using low beach angle, deep pool depths, high scroll differential speed, and high bowl speed rpm.

In one embodiment, water 98 has a solids content of less than about 3 wt %. The centrate water 98 may be collected and either discharged 102 back to the tailings pond or diverted 86 into a line for recycling for feed dilution or other processes such as flocculant dilution.

In another embodiment, the flocculated material is treated with a thickener, resulting in thickened tailings (TT) product 94 and the water stream 98. The TT product may have a solids content of 40-50%, while the water stream may contain less than 1% solids.

In one embodiment, the cake 94 has a solids content of at least about 50 wt %. The cake or TT 94 may be collected and transported via a conveyor, pump or transport truck to a disposal area. At the disposal area, the cake or TT 94 is stacked to maximize dewatering by natural processes including consolidation, desiccation and freeze thaw via 1 to 2 m thick annual lifts to deliver a trafficable surface that can be reclaimed. In another embodiment, cake or TT 94 can be placed in deep pits where dewatering includes desiccation and freeze thaw, but primarily consolidation. In another embodiment, cake to TT is placed at the bottom of End Pit Lakes.

Exemplary embodiments of the present invention are described in the following Example, which is set forth to aid in the understanding of the invention, and should not be construed to limit in any way the scope of the invention as defined in the claims which follow thereafter.

Example 1

Tests were conducted to show bitumen recovery from fluid fine tailings.

An FFT sample was obtained from the Syncrude site in Fort McMurray, Alberta, Canada. The sample contained 33.79% solids and 1.97% bitumen. Kerosene was added at 834 g/t as a bitumen collector.

A 2.3-2.5 $m^3$ sample of the FFT was added to a separator tank and mixed for 5 minutes, followed by aeration for a total of 33 minutes. The temperature was ambient at about 22° C.

The bitumen froth was collected by hand and analyzed.

Though kerosene was added to facilitate flotation, the bitumen recovery was less than 1%. The froth quality was very low with about 2% bitumen.

The bitumen in undiluted FFT is hard to recover by flotation at ambient temperatures.

Example 2

Tests were conducted to study bitumen recovery from fluid fine tailings when combined with froth treatment tailings.

Four FFT samples were obtained from an FFT Centrifuge Field Test Plant at the Mildred Lake Settling Basin from the Syncrude site in Fort McMurray, Alberta, Canada.

The compositions of the FFT samples are shown in Table 1. The samples contain an average bitumen content of 2.34%, solids content of 37.11% and water of 60.74%. The average −44 μm fines content is 94.16% and the average −2 μm clay content 28.51%. The consistency of the FFT sample particle size distribution (PSD) was good.

Solids content of the tested FFT probably represented a "high-end" of the expected levels from a commercial operation, for example dredge-recovered FFT. A typical delivered FFT density is expected at about 30-35% solids.

TABLE 1

Compositions of FFT samples for the lab tests

| Name | Bitumen % | Water % | Solids % | −2 μm % | −44 μm % |
|---|---|---|---|---|---|
| FFT-1 | 2.35 | 61.39 | 37.04 | 27.78 | 93.10 |
| FFT-2 | 2.37 | 60.81 | 36.98 | 28.81 | 95.22 |
| FFT-3 | 2.35 | 60.38 | 37.33 | 28.90 | 94.19 |
| FFT-4 | 2.29 | 60.39 | 37.34 | 28.53 | 94.12 |
| Average | 2.34 | 60.74 | 37.17 | 28.51 | 94.16 |

Samples of hot froth treatment tailings were obtained from the Syncrude site in Fort McMurray, Alberta, Canada. In Syncrude operations, hot froth treatment tailings, which are those tailings having been through both froth treatment and solvent recovery, are known as Plant 6 tailings (P6 tails). The assays of two samples of Plant 6 tailings are given in Table 2. The samples contain an average bitumen content of 2.65%, solids content of 10.58% and water content of 85.60%. The average −44 μm fines content is 83.51% and the average −2 μm clay content 17.98%. So the particles of Plant 6 tailings are relatively coarser than FFT.

TABLE 2

Compositions of Plant 6 tailings samples for the lab tests

| Name | Bitumen % | Water % | Solids % | −2 μm % | −44 μm % |
|---|---|---|---|---|---|
| P6 Tails-1 | 2.67 | 85.57 | 10.94 | 18.39 | 83.26 |
| P6 Tails-2 | 2.62 | 85.63 | 10.22 | 17.57 | 83.75 |
| Average | 2.65 | 85.60 | 10.58 | 17.98 | 83.51 |

It is known that Plant 6 tailings contain heavy minerals such as rutile, ilmenite, zircon and pyrite, etc. To investigate the flotation behavior of Plant 6 tailings without the heavy minerals, an additional Plant 6 tailings sample was de-sanded by siphoning the upper fine slurry after homogeneously mixing the Plant 6 tailings and then statically settling for 1.5 min. The compositions of the de-sanded fines (DS-Fines1 and DS-Fines2) and sand materials (DS-Sand1 and DS-Sand2) are given in Table 3.

TABLE 3

Compositions of the de-sanded Plant 6 tailings samples for the lab tests

| Name | Bitumen % | Water % | Solids % | −2 μm % | −44 μm % |
|---|---|---|---|---|---|
| DS-Fines1 | 2.75 | 84.93 | 11.20 | 18.27 | 84.24 |
| DS-Fines2 | 2.77 | 85.17 | 11.25 | 17.66 | 83.24 |
| Average | 2.76 | 85.05 | 11.23 | 17.97 | 83.74 |
| DS-Sand1 | 1.75 | 27.45 | 70.31 | 4.49 | 21.40 |
| DS-Sand2 | 2.00 | 26.97 | 69.73 | 4.10 | 18.72 |
| Average | 1.88 | 27.21 | 70.02 | 4.30 | 20.06 |

As shown in Table 3, the bitumen content and the solids content in the de-sanded fines fraction are slightly higher compared with those in Table 2, while the −44 μm fines content and the −2 μm clay content are not changed. In the sand fraction, however, the solids content was increased to 70% and the −44 μm fines content and the −2 μm clay content are significantly reduced to 20.1% and 4.3% respectively. As only a very small amount of sand was removed from the raw Plant 6 tailings, the PSDs of the de-sanded fines fraction overlapped with those of the raw Plant 6 tailings.

Flotation tests were conducted using the FFT and Plant 6 samples. The test matrix for the lab flotation tests is shown in Table 4. The main test variable for the flotation tests is the ratios of Plant 6 tailings to FFT which determine the mixed feed solids content and temperature for both the raw and de-sanded Plant 6 tailings. Table 4 also shows the estimated and measured feed solids contents, the calculated and measured temperatures, and the time to reach to a steady temperature (i.e., equilibrium) for mixing the two feed materials. Table 4 shows that the calculated and measured temperatures are quite consistent. The time to reach to a steady temperature was usually 30-60 seconds. The estimated flotation feed solids contents based on the Plant 6 tailings solids content, the FFT solids content and their mixing ratios are quite close to the measured feed solids contents.

TABLE 4

Test matrix for the lab flotation tests

| Test No. | Plant 6 tails | Ratio by Vol. PL6Tails/FFT | Agitat'n rpm | Aeration ml/min | Feed solids % Estimated | Feed solids % Measured | Temperature ° C. Calculated | Temperature ° C. Measured | Time (sec) to equilibrium |
|---|---|---|---|---|---|---|---|---|---|
| P6M-1 | Raw | 1:2 | 1500 | 150 | 31.3% | 30.66% | 41 | 41.4 | 56 |
| P6M-2 | Raw | 1:1 | 1500 | 150 | 27.1% | 25.57% | 52 | 53.6 | 45 |
| P6M-3 | Raw | 2:1 | 1500 | 150 | 22.7% | 22.33% | 64 | 64.3 | 43 |
| P6M-4 | Raw | 3:1 | 1500 | 150 | 20.3% | 21.15% | 70 | 65.6 | 55 |
| P6M-8 | Desanded | 1:2 | 1500 | 150 | 30.4% | 30.17% | 41 | 42.3 | 35 |
| P6M-9 | Desanded | 1:1 | 1500 | 150 | 26.0% | 25.71% | 52 | 51.6 | 46 |
| P6M-10 | Desanded | 2:1 | 1500 | 150 | 20.4% | 21.14% | 64 | 63.6 | 43 |
| P6M-11 | Desanded | 3:1 | 1500 | 150 | 18.5% | 19.83% | 70 | 68.2 | 51 |

Flotation Procedure

A Denver flotation machine and a 1.5-liter cell equipped with a warm water jacket were used for the lab flotation tests. Before the flotation tests, the samples were homogenized using a mechanical mixer. Predetermined volumes of samples were taken out from the FFT and Plant 6 tailings sample pails and put into beakers respectively. To heat up the Plant 6 tailings to 90° C., simulating the similar temperature in operation, and to minimize the changes in solid-bitumen interaction, the Plant 6 tailings sample was warmed up in an oven without any mechanical disturbance. Even under such conditions, it was observed that there was a bitumen layer floating at the top of the warmed slurry. It was possibly due to the heat convection of the slurry, resulting from the temperature changes inside the slurry. The water jacket temperature was set at a value as calculated based on the ratio of Plant 6 tailings to FFT. After mixing FFT and Plant 6 tailings at a certain ratio to reach a steady temperature, aeration started and froth samples at times of 3, 6, 10 and 20 min were collected into 4-oz glass jars, weighed and held for analysis. The flotation tailings after taking the above-noted 4-oz sample were stored in a 2-liter beaker for subsequent flocculation and settling tests. For the de-sanded Plant 6 tailings, the flotation test procedure was the same as above.

Flocculation Procedure

Six flotation tailings samples from the above flotation tests were selected to perform flocculation and settling tests with graduated cylinders. The test numbers were P6M-4, P6M-11 and P6M-12. All settling tests were conducted at room temperature (21° C.) except for a repeated one (P6M-11) at 50° C. for comparison purpose. An anionic flocculant was employed, which is an anionic polyacrylamide-sodium polyacrylate co-polymer with a high molecular weight (about 10,000 kD or higher) and a medium charge density (about 20 to 35% anionicity). The polymer is available as SNF A3338. The flocculant was used at a fixed dosage of 800 g/t, which was prepared using recycle water (RCW).

The flocculation procedure is summarized as follows.

Calculated the solids weight in the tailings sample and the amount of flocculant solution to be added;

Poured the tailings sample into a 2-liter beaker;

Pre-mixed the sample at 600 rpm for 2 min with an impeller (Lightnin A310 impeller 3.4" diameter (86 mm)×⅜" bore diameter). The distance between the impeller bottom and the beaker bottom was 2.5 cm;

Kept the mixer running at 600 rpm and simultaneously injected the predetermined amount of 0.4% flocculant solution into the tailings sample through a tube in 3 min and then allowed 0.5 min additional mixing;

Poured the above flocculated sample into a 2-liter graduated cylinder;

Recorded the settling heights versus time over a period of 24 hours with an AITF camera system;

During the testing, took supernatant samples to measure the solids contents at 10 min and 24 hrs and took a sediment sample to determine the solids content at 24 hrs.

Gaudin Selectivity Index

Recovery and grade of concentrates are most popularly used to evaluate flotation performance in mineral processing and oil sand industries. However, sometimes they are not enough to evaluate the separation efficiency because they depend on the feed grades. Gaudin selectivity index is one of the supplemental terms used to gauge flotation selectivity. It was defined as a geometric mean of the relative floatability and the relative rejectability for component a against component b (Taggart A., (1954). *Handbook of Mineral Dressing, Section* 19 *Sampling and Testing*, p. 19-195-19-196).

The Gaudin selectivity index is expressed in Equation (1).

$$\text{Gaudin } S.I. = \left(\frac{R_a}{R_b} \times \frac{J_b}{J_a}\right)^{1/2} \quad (1)$$

where Ra is recovery of component a in concentrate, Rb recovery of component b in concentrate, Ra/Rb relative floatability of a to b; Ja is rejection of component a in tailings, Ja=100−Ra in a separation process with two outputs; Jb is rejection of component b in tailings, Jb=100−Rb in a separation process with two outputs; Jb/Ja is relative rejectability of b to a.

If Gaudin selectivity index is equal to 1, there is no selective separation between the two components. Gaudin selectivity index was used to evaluate the flotation selectivity between bitumen and solids in this series of lab flotation tests.

Results and Discussion

As mentioned earlier, this series of tests were conducted with both raw and de-sanded Plant 6 tailings being combined with FFT at different ratios. The test results are presented for raw Plant 6 tailings and de-sanded Plant 6 tailings respectively.

Figure 3:
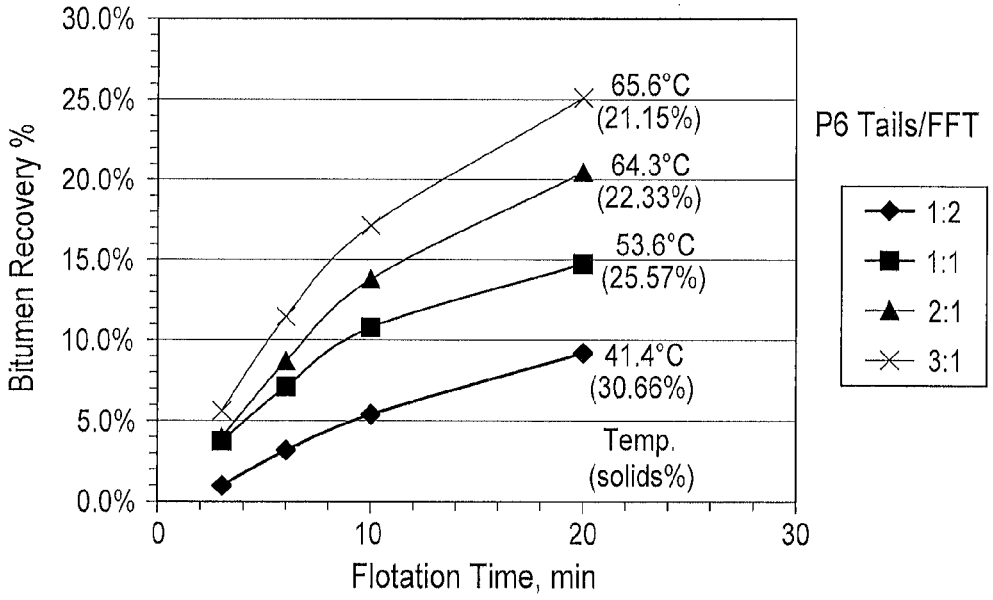
FIG. 3 is a graph showing the effect of ratios of heated tailings (P6 Tails) to storage pond tailings (FFT) on bitumen flotation kinetics.

Raw Plant 6 Tailings and FFT Tests:

The effect of ratios of Plant 6 tailings to FFT on bitumen flotation kinetics is shown in FIG. 3, in which the feed solids content and temperature are also indicated. As mentioned earlier, the Plant 6 tailings sample was pre-heated to 90° C. and the FFT sample was kept at ambient temperature of 21° C. When changing the volume ratios of Plant 6 tailings to FFT in the flotation feeds from 1:2 to 3:1, the feed solids contents were accordingly decreased from 30.66% to 21.15% and the temperatures were increased from 41.4° C. to 65.6° C. As shown in FIG. 3, the ratios of Plant 6 tailings to FFT had a significant effect on the bitumen flotation kinetics. The more dilute the flotation feed, the faster is the bitumen flotation rate.

Figure 4:
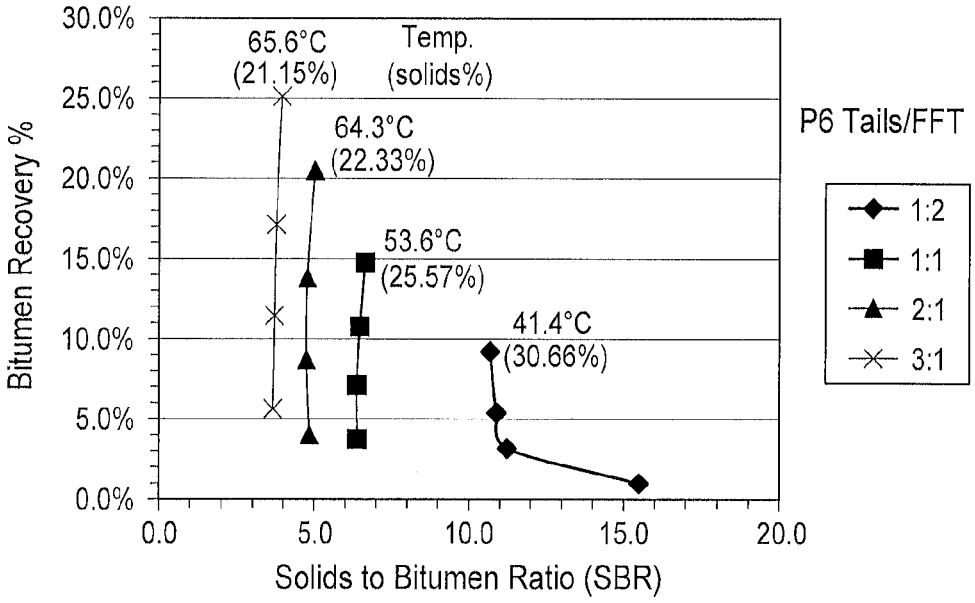
FIG. 4 is a graph showing the effect of ratios of heated tailings to storage pond tailings on the cumulative bitumen recoveries and the cumulative solids to bitumen ratios.

FIG. 4 shows the effect of ratios of Plant 6 tailings to FFT on the cumulative bitumen recoveries and the cumulative solids to bitumen ratios (SBR) in the froth products. It is clear that the solids to bitumen ratios were reduced with the enhanced ratios of Plant 6 tailings to FFT from 1:2 to 3:1. Data is shown for each of the tested flotation residence times, in each data series.

Figure 5:
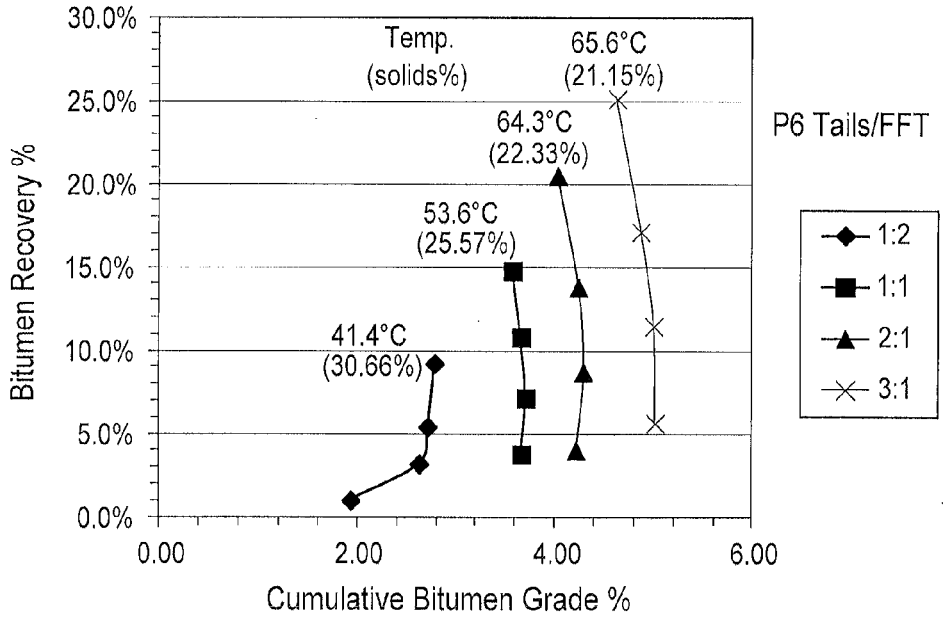
FIG. 5 is a graph showing the effect of ratios of heated tailings to storage pond tailings on cumulative bitumen recoveries and grades.

FIG. 5 demonstrates the effect of ratios of Plant 6 tailings to FFT on cumulative bitumen recoveries and grades. It is evident that more dilution of FFT with the Plant 6 tailings resulted in higher bitumen recovery and grade.

Figure 6:
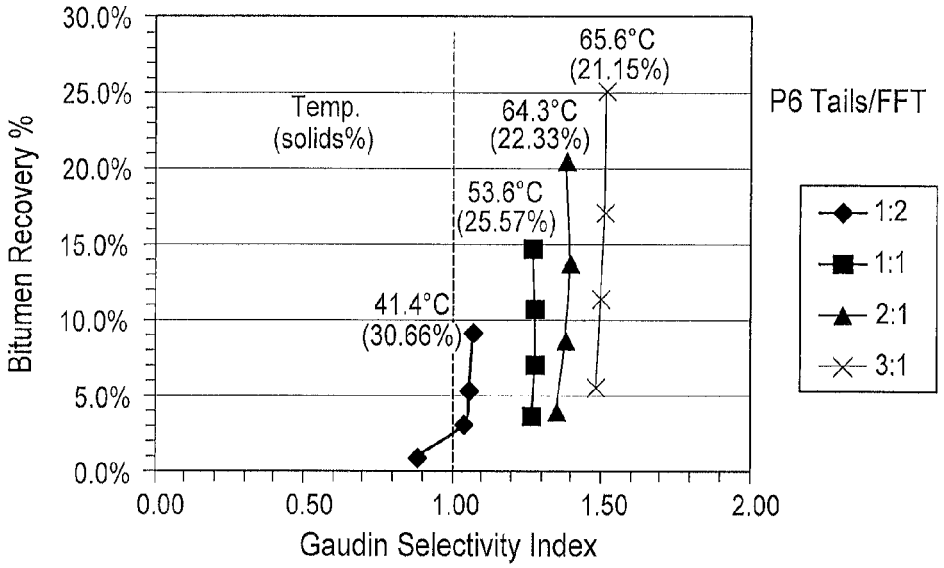
FIG. 6 is a graph showing the effect of ratios of heated tailings to storage pond tailings with respect to a Gaudin Selectivity Index.

The Gaudin selectivity index between bitumen and solids is shown in FIG. 6. When the ratio of Plant 6 tailings to FFT was 1:2 which gave a flotation feed of 30.66% solids, the selectivity index was close to 1. It means that at such a dilution ratio, almost no selective separation between bitumen and solids took place. With the enhanced ratios of Plant 6 tailings to FFT from 1:2 to 3:1, the selectivity between bitumen and solids was gradually improved. At the 3:1 dilution ratio of Plant 6 tailings to FFT, the flotation feed density was 21.15% solids and the bitumen recovery was 25%.

De-Sanded Plant 6 Tailings and FFT Tests:

This series of tests with the de-sanded Plant 6 tailings were performed to investigate the flotation behavior when the heavy minerals were removed from the Plant 6 tailings. The de-sanded fines were mixed with FFT at different ratios for the flotation tests. The de-sanded Plant 6 tailings sample was pre-heated to 90° C. and the FFT sample was kept at an ambient temperature of 21° C. When changing the volume ratios of de-sanded Plant 6 tailings to FFT in the flotation feeds from 1:2 to 3:1, the feed solids contents were accordingly decreased from 30.17% to 19.83% and the temperatures were increased from 42.3° C. to 68.2° C. The test results were very similar to those noted above for raw Plant 6 tails. In particular, the more dilute the flotation feed, the better the results.

Flocculation and Settling Tests:

Six flocculation and settling tests on the lab flotation tailings samples were performed with SNF A3338 at a fixed dosage of 800 g/t in order to check the flocculation behavior of the combined Plant 6 tailings and FFT. The settling data are given in Table 5. The more dilute the flocculation feed, the faster was the settling rate.

TABLE 5

Settling data of the selected lab flotation tailings flocculated with 800 g/t SNF A3338

| Test # | P6Tails/FFT by Vol. | Feed Solids % | 10 min supernatant Solids % | 24 hr supernatant Solids % | 24 hr sediment Solids % | 24 hr release water % by Vol. |
|---|---|---|---|---|---|---|
| P6M4 | 3:1 | 21.15% | N/A | 0.60% | 30.13% | 35.65% |
| P6M11 | 3:1 | 19.83% | 0.62% | 0.56% | 32.29% | 36.54% |
| P6M11 at 50° C. | 3:1 | 19.83% | 0.58% | 0.54% | 33.58% | 42.37% |
| P6M12 | 1:1 | 25.90% | N/A | 0.44% | 29.33% | 8.66% |

It is interesting to notice in Table 5 that the flocculation at 50° C. significantly increased the initial settling rate and the water release compared with that at ambient temperature of 21° C. for the same samples from the combined de-sanded Plant 6 tailings and FFT at 3:1.

Large floc particles were observed, indicating a good flocculation was achievable with 800 g/t SNF A3338 for the combined Plant 6 tailings and FFT. The flocculated materials may be suitable for centrifugation.

Example 3

Test Materials and Set-Up

Six 20-L pails of Plant 6 tailings (6Tails), three pails of FFT and six pails of recycled process water (RCW) were obtained from the Syncrude site. The composition and particle size distribution of tailings samples were analyzed and the results are summarized in Table 6.

TABLE 6

Properties of Tailings Samples

| Sample ID | Bitumen % | Water % | Solids % | 44 um % | d50 um | SFR |
|---|---|---|---|---|---|---|
| 6Tail 1/6 | 2.39 | 81.34 | 16.88 | 63.05 | 24.76 | 0.586 |
| 6Tail 2/6 | 2.4 | 82.87 | 17.55 | 71.69 | 15.78 | 0.395 |
| 6Tail 3/6 | 2.29 | 83.47 | 16.29 | 80.23 | 12.04 | 0.246 |
| 6Tail 4/6 | 2.59 | 83.79 | 16.91 | 72.17 | 16.06 | 0.386 |
| 6Tail 5/6 | 2.26 | 83.11 | 16.73 | 75.38 | 14.73 | 0.327 |
| 6Tail 6/6 | 2.23 | 83.02 | 16.66 | 75.11 | 14.46 | 0.331 |
| FFT 1/3 | 2.71 | 63.3 | 35.46 | 89.19 | 5.74 | 0.121 |
| FFT 2/3 | 2.59 | 64.5 | 34.77 | 88.82 | 5.85 | 0.126 |
| FFT 3/3 | 2.65 | 63.81 | 35.70 | 93.76 | 5.34 | 0.067 |

Although bitumen content in 6Tails and FFT were similar (about 2.5%), there were much more fines (−44 mm) present in FFT. In addition, the sand to fines ratio (SFR) was low for both samples (<0.6).

Test Set-Up

Sample Homogenization:

A specifically designed baffle was fixed in a 20-L pail. To ensure that coarse sands at the bottom of the pail could be suspended and homogenized completely in the pail, a powerful hand drill with a mixer was used to mix the slurry. Before each test, a given amount of sample was taken from the well mixed 20-L sample pail.

Flotation Test:

After exploratory tests to evaluate the impact of impeller selection, agitation intensity (rpm), aeration rate and cell volume, it was found that a 2-L Denver flotation cell with 1200 rpm and 0.8-L/min. aeration could give reasonably stable froth in the cell. Therefore, a 2-L Denver flotation cell was used for all the flotation tests.

Test Procedures

The basic steps involved are summarized below:

- Agitate both 6Tails and FFT samples in their holding 20-liter buckets to ensure homogeneous mixing of the slurries.
- Calculate and weigh the 6Tails, FFT and RCW samples based on the total volume of 2-L for each test, the ratio of 6Tails to FFT, the target combined feed solids content and the original tailings solids contents (Table 6).
- Pre-heat the mixture of the weighted 6Tails, FFT and RCW samples in an oven to the target temperature. Pour the mixture samples into the 2-L flotation cell and turn on the agitation at 1200 rpm for 2 min. conditioning.
- Set the thermostat of water bath connected with the water jacket to the target temperature and maintain it during the subsequent flotation test.
- Turn on airflow meter to control the aeration rate at a given value. Start timing immediately when beginning the aeration. Collect bitumen froth into separate jars directly at flotation time of 3, 5, 10 and 25 min. respectively.
- After finishing flotation, collect the flotation tailings in a 2-L beaker, weigh the flotation tailings, and estimate solids content in the tailings.

Bitumen Flotation Recovery

Figure 7:
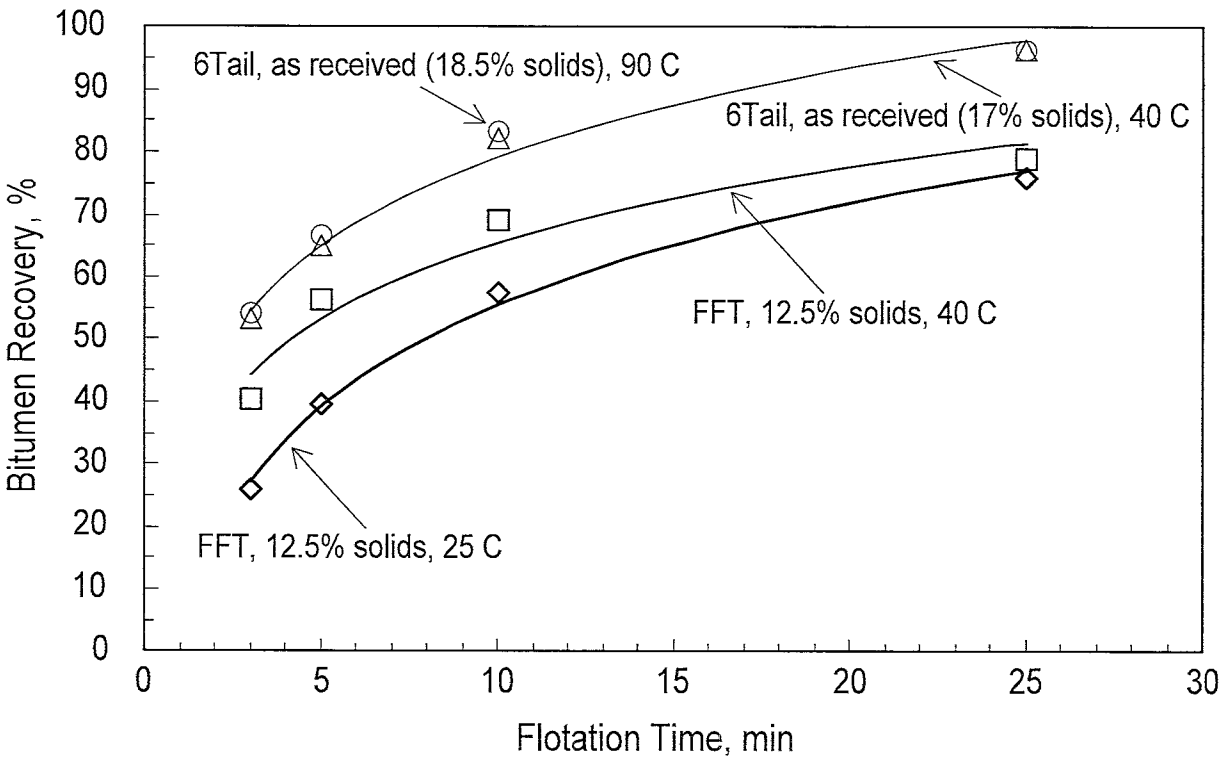
FIG. 7 is a graph showing bitumen recoveries from treatment of samples of heated tailings (6Tail) and storage pond tailings (FFT).

To evaluate the role of mixing 6Tails with FFT in flotation performance, baseline flotation tests using FFT (12.5% solids) and 6Tails (as received) alone at different temperatures were carried out first. The results in FIG. 7 showed that bitumen recovery from 6Tails was faster than those from FFT. Some of the reasons could be attributed to smaller bitumen droplets present in FFT, and fewer fines in 6Tails. In addition, the residual bitumen from 6Tails was the bitumen floated to the froth, while the bitumen in FFT was those unrecoverable during extraction. Increasing operating temperature from 25 to 40° C. accelerated bitumen recovery for FFT samples. Increasing flotation temperature could reduce slurry and bitumen viscosity, accelerate bitumen liberation from solids particles, and increase activation energy for bitumen-bubble attachment, all contributing to accelerated bitumen recovery. However, for 6Tail samples, increasing operating temperature from 40 to 90° C. (typical temperature of plant 6 tailings) virtually did not increase bitumen recovery.

It can also be noted from FIG. 7 that more than 90% bitumen recovery was obtained from 6Tails, and about 75% from FFT, which was much higher than the targeted bitumen recovery of >50%. These results demonstrated the importance of dilution of FFT for improving bitumen recovery. In FIG. 7, the FFT in the flotation feed was diluted to 12.5% solids, while in Example 2 the lowest flotation feed was about 21.15% solids, which resulted in about 25% bitumen recovery.

Bitumen Froth Quality

Analyzing bitumen froth quality through bitumen to solids ratio (FIG. 8) and bitumen to water ratio (FIG. 9) revealed that froth quality from 6Tail and FFT was poor.

Figure 8:
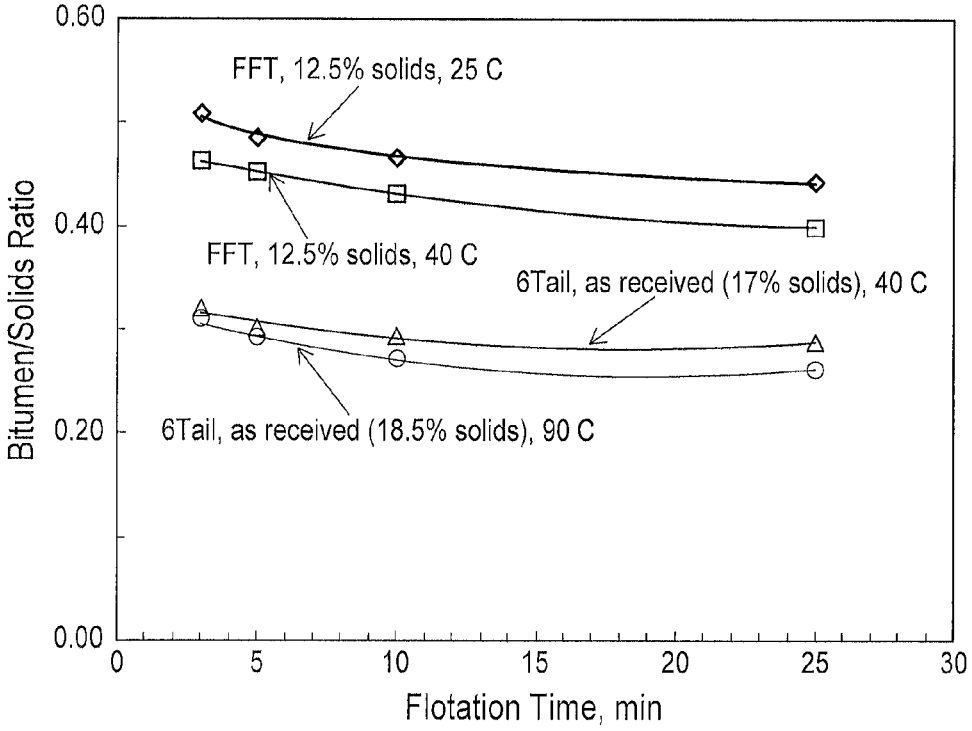
FIG. 8 is a graph showing bitumen to solids ratios of froth from treatment of samples of heated tailings and storage pond tailings.
Figure 9:
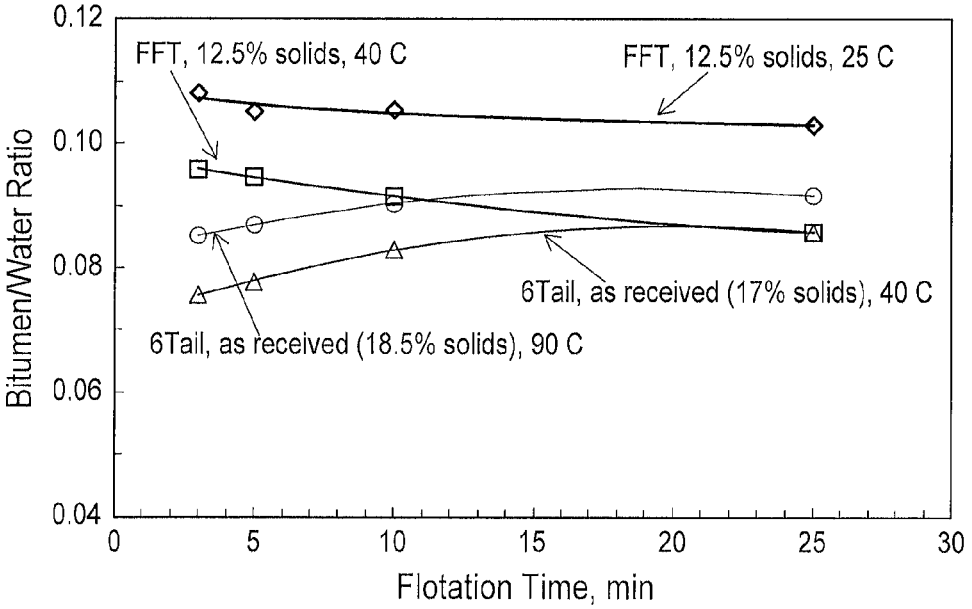
FIG. 9 is a graph showing bitumen to water ratios of froth from treatment of samples of heated tailings and storage pond tailings.

In particular, in commercial oil sands extraction, bitumen to solids and bitumen to water ratio in the froth could be in the range of 4 and 2, respectively. As shown in FIG. 8, bitumen to solids ratio was less than 0.5 for FFT, and 0.3 for 6Tails. It is obvious that fines present in the tailings could be responsible for the poor froth quality. Since particle size from 6Tail was larger than that from FFT (Table 6), the lower bitumen to solids ratio from 6Tail in the froth would suggest that the bitumen from 6Tails was less liberated from sands than those in FFT. Another reason could be that the heavy minerals enriched in the froth are still hydrophobic and float together with bitumen to the froth, making the froth quality poorer. This observation would suggest that the lower bitumen recovery from FFT than 6Tails (FIG. 7) would be mainly attributed to smaller bitumen droplet sizes (not the liberation), with lower collision and attachment probability of the bitumen droplets to bubbles in FFT than those in 6Tails.

Effect of Feed Solids Content

This set of tests was conducted to determine what feed solids content could give optimized bitumen recovery and froth quality.

In these tests, a starting mixture of ratio 2:1 for 6Tails: FFT was diluted with recycle water to arrive at samples with 5%, 7.5%, 10%, 12.5%, 15%, 17.5% and 20%. For each sample flotation was conducted at temperatures 25° C., 40° C. and 55° C. Aeration was continued for 25 minutes.

Figure 10:
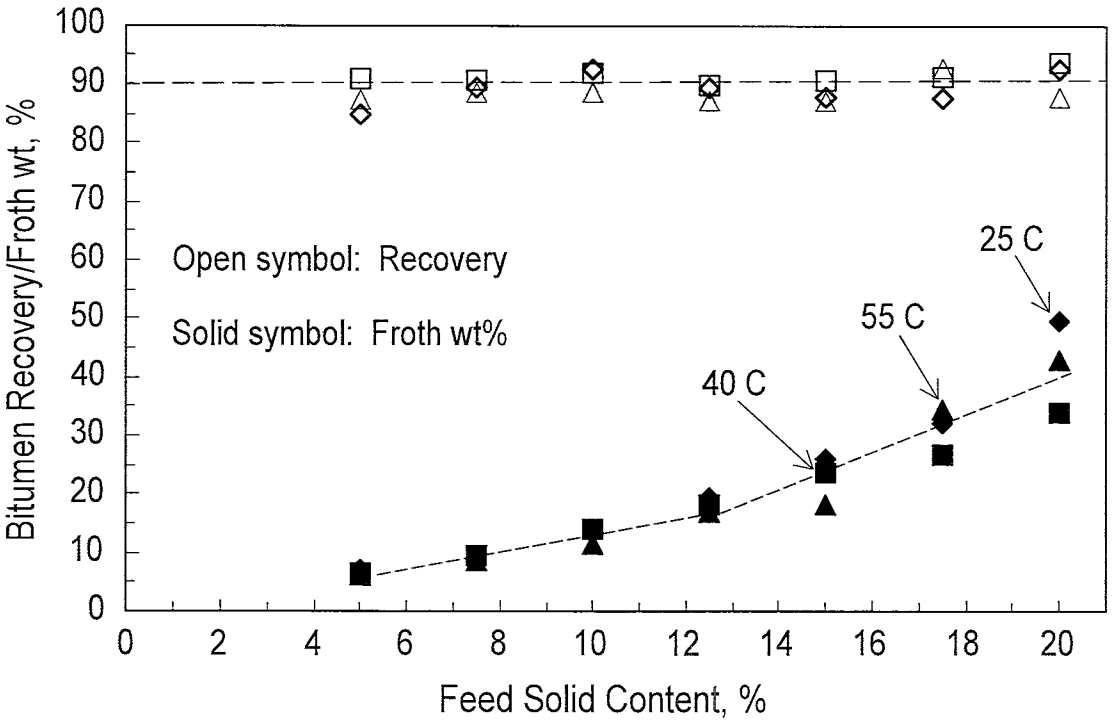
FIG. 10 is a graph showing the effect of feed solids content on bitumen recovery and froth weight from treatment of a mixture of heated tailings and storage pond tailings.
Figure 11:
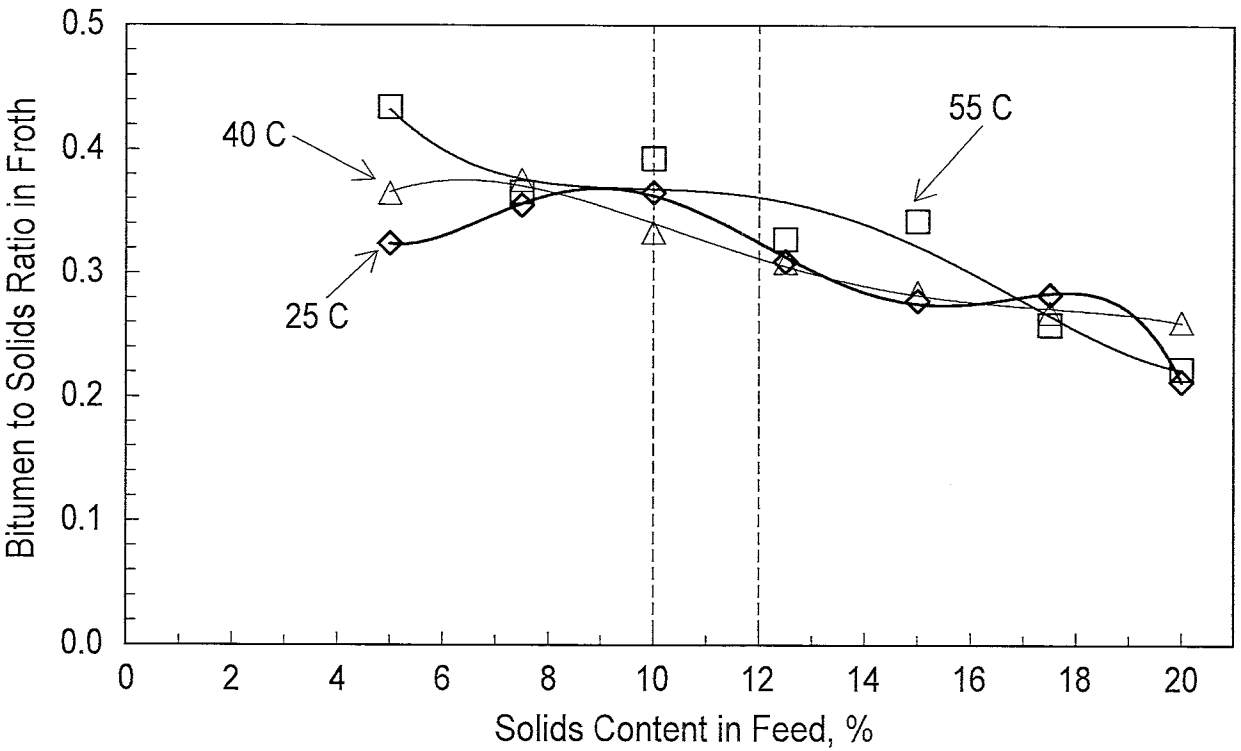
FIG. 11 is a graph showing the effect of feed solids content on bitumen froth quality expressed as bitumen to solids ratio from treatment of a mixture of heated tailings and storage pond tailings.

As shown in FIG. 10, up to 90% bitumen recovery was obtained, and bitumen recovery did not change too much with increasing solids content in the feed. However, the froth weight changed significantly. Increasing feed solids content increased the froth product weight. Two straight lines could be drawn, in terms of froth weight vs. feed solids content (FIG. 10): the first from 5% to 12.5% solids, and the second from 12.5% to 20% solids. When the feed solids content was higher than 12.5 wt %, the increase in froth weight became even faster, with a steeper slope of the straight line. In this case, the entrapment of solids into bitumen-bubble aggregates recovered to the froth could contribute to the increased froth weight. Since bitumen recovery virtually did not increase, the increased froth weight with increasing feed solids content would indicate the froth quality could become worse. Indeed, as shown in FIG. 11, bitumen froth quality as expressed by bitumen to solids ratio (B/S) in the froth decreased with increasing feed solids content. Especially when the feed solids content was higher than 10-12.5%, the ratio reduced more significantly. Therefore, considering operation capacity and froth quality, a feed solids content of 12 wt % or less is most useful.

Effect of Temperature

To evaluate the effect of temperature on bitumen recovery from the tailings mixture, mixtures were prepared with 6Tails/FFT at a ratio of about 2 having temperatures of 25, 40 and 55° C. In general, it was discovered that there is a reverse relationship between recovery and concentrate grade (or froth quality): increasing recovery could make froth quality worse. To have a reasonable comparison, the plot of recovery-grade curve is normally used in mineral flotation separation to identify optimized conditions: the curve on the far right side gives the best performance. For this reason, the 25-minute cumulative bitumen recovery was plotted against the 25-minute cumulative bitumen content in the froth for each of the tested feed solids content from 5% to 20%.

Figure 12:
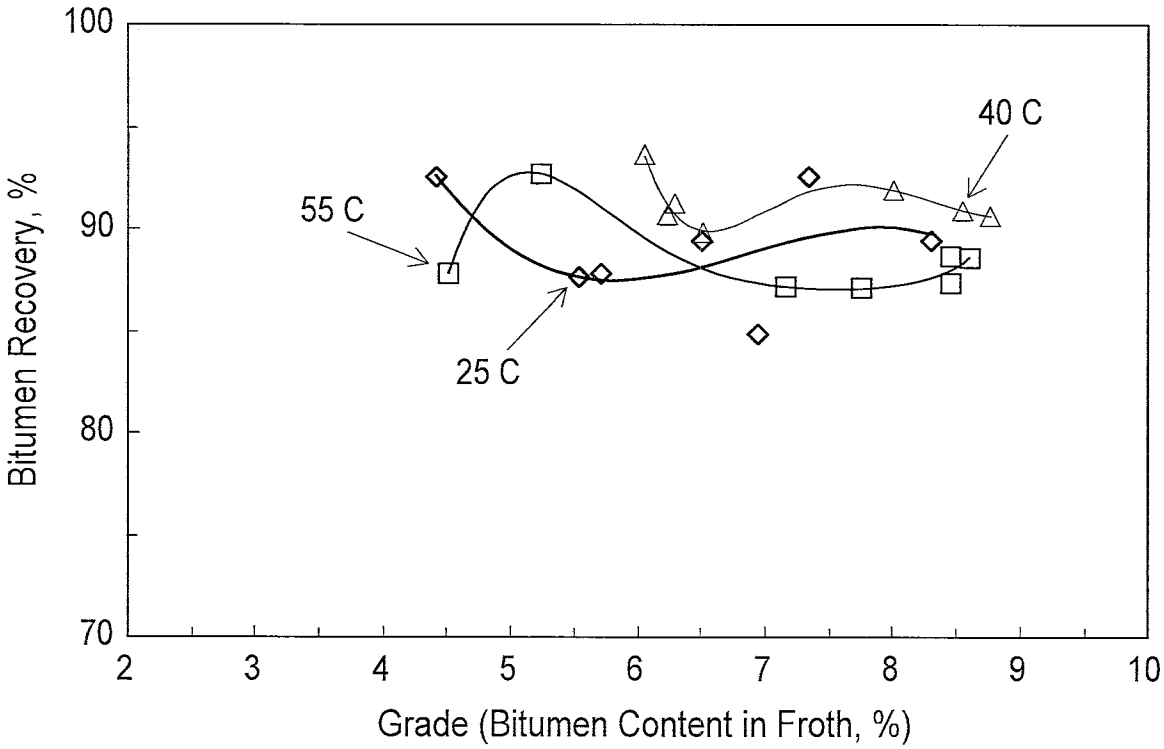
FIG. 12 is a graph showing the effect of temperature on bitumen recovery and grade of froth from the mixture of heated tailings and storage pond tailings.

As clearly shown in FIG. 12, the tests at 40° C. gave the best flotation performance, i.e., at the same concentrate grade or bitumen content in the froth, a highest bitumen recovery, on average, was obtained at 40° C. Raising extraction temperature to 55° C. virtually did not improve flotation separation performance, although increasing extraction temperature decreases bitumen and slurry viscosity, accelerates bitumen liberation from the sands, and enhance bitumen-bubble attachment, with the potential of increasing bitumen recovery and bitumen froth quality. The exact reasons for such extraction behavior remain to be explored. From the test results, it appeared that using extraction temperature at about 40° C. was sufficient to have maximized extraction performance.

Effect of 6Tails' to FFT Ratio

This set of tests was aimed at establishing suitable volumetric ratios of 6Tails to FFT for the treatment of two tailings mixed together. Samples were prepared with volumetric ratios of 6Tails to FFT of 1.5, 2 and 3. These samples were diluted to 5%, 7.5%, 10%, 12.5%, 15%, 17.5% and 20%. To minimize the effect of other operating variables the extraction temperature was fixed at 40° C. The total flotation time was 25 minutes.

Figure 13:
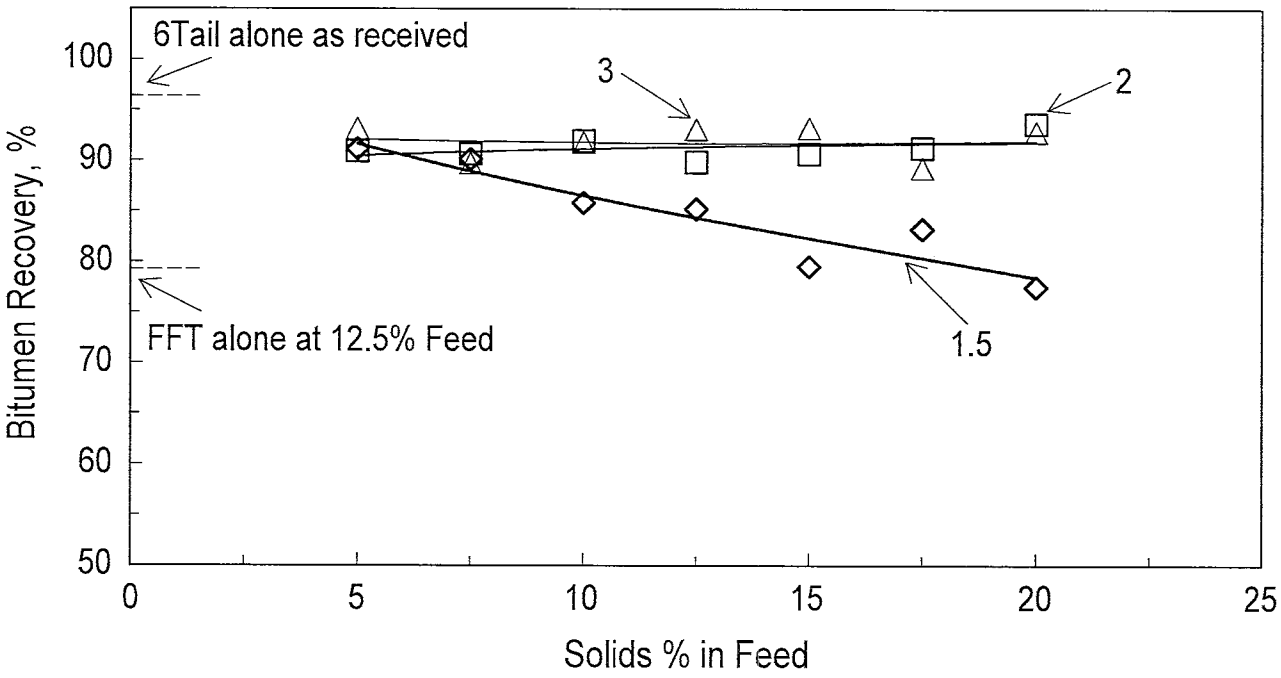
FIG. 13 is a graph showing the effect of feed solids contents and volumetric ratio of heated tailings to storage pond tailings on bitumen recovery.

FIG. 13 shows the bitumen recovery at different volumetric ratios of 6Tails to FFT and solids content in the feed. For the ratio of 6Tail to FFT at 1.5, bitumen recovery decreased with increasing solids content in the feed. However, with raising volumetric ratio of 6Tail to FFT to 2 and 3, virtually no difference in bitumen recovery was observed with the tested solids content in the feed. It is known that increasing solids content in the feed increased slurry viscosity, which could retard bitumen-bubble interactions and bitumen-bubble aggregates rising to the froth. Since the solids in FFT are much smaller than those in 6Tails (Table 6), the actual amount of fine solids in the feed would be much higher for the ratio of 1.5, as compared to 2 and 3, resulting in reduced bitumen recovery with increasing total solids content in the feed at the ratio of 1.5.

Another observation from FIG. 13 was that bitumen recovery of 6Tails alone (from FIG. 7) was always higher than that for 6Tail-FFT mixture, as expected. But the lowest recovery of the mixture at a higher feed solids content of >15% was even lower than FFT alone diluted at 12.5% solids. However, for the mixture at 12.5% feed solids, the obtained bitumen recovery was 85.23%, which was higher than 79% for FFT alone (from FIG. 7), thus there is a synergistic benefit from combining the 6Tails with the FFT.

Figure 14:
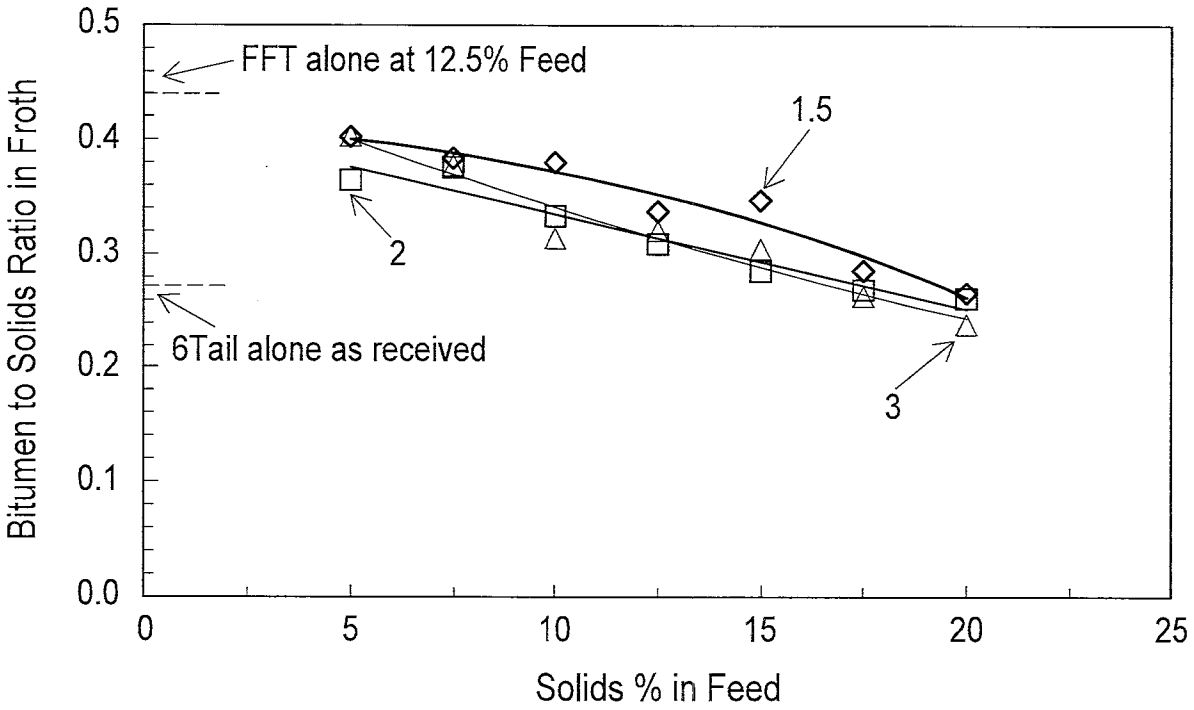
FIG. 14 is a graph showing the effect of feed solids contents and volumetric ratio of heated tailings to storage pond tailings on froth quality.

FIG. 14 shows the effect of mixing FFT with 6Tails at different volumetric ratio on bitumen froth quality as expressed by bitumen to solids ratio in the froth at 40° C. Mixing FFT with 6Tails dropped bitumen froth quality, due to lower froth quality of 6Tails than that of FFT (FIG. 8). Increasing solids content in the feed decreased froth quality, probably resulting from a higher probability of mechanical entrapment of solids inside bitumen-bubble aggregates. Increasing the volumetric ratio of 6Tails to FFT also dropped froth quality, because of the lower froth quality of 6Tails than that of FFT. By considering bitumen recovery and froth quality, it appeared that the volumetric ratio of 6Tails to FFT of about 2 was most suitable for bitumen removal from the mixture.

From the foregoing description, one skilled in the art can easily ascertain the essential characteristics of this invention, and without departing from the spirit and scope thereof, can make various changes and modifications of the invention to adapt it to various usages and conditions. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims.

We claim:

1. A method for recovering bitumen from storage pond tailings, the method comprising:

a. combining the storage pond tailings with a heated tailings stream to form a tailings mixture, the storage pond tailings having a temperature and a solids content and the tailings mixture having a resulting solids content less than the solids content of the storage pond tailings; and b. treating the tailings mixture to recover bitumen therefrom.

2. The method of claim 1 wherein the storage pond tailings are fluid fine tailings.

3. The method of claim 1 wherein the storage pond tailings have a temperature of 5 to 20° C. and a solids content of 30 to 40 wt %.

4. The method of claim 1 wherein the heated tailings stream is selected from the group consisting of bitumen extraction fine tailings, hydrocyclone overflow, froth treatment tailings including those from solvent froth treatment or hot froth treatment tailings from the solvent recovery unit and any combination thereof.

5. The method of claim 1 wherein the heated tailings stream has a temperature of about 30 to 100° C.

6. The method of claim 1 wherein the heated tailings stream is froth treatment tailings.

7. The method of claim 6 wherein the froth treatment tailings are hot froth treatment tailings from a solvent recovery unit.

8. The method of claim 6 wherein the hot froth treatment tailings have a temperature of 85 to 95° C. and a solids content of less than 25%.

9. The method of claim 1 wherein combining provides the tailings mixture with a resulting temperature higher than the temperature of the storage pond tailings.

10. The method of claim 9 wherein the resulting temperature is greater than 25° C.

11. The method of claim 1 wherein the resulting solids content is less than 20%.

12. The method of claim 11 wherein the resulting solids content is less than the gel point of the storage pond tailings.

13. The method of claim 11 wherein the resulting solids content is less than 12 wt %.

14. The method of claim 1 wherein combining further comprises adding water to form the tailings mixture if necessary.

15. The method of claim 14 wherein the water is recycle water.

16. The method of claim 14 wherein the resulting solids content is less than 20%.

17. The method of claim 14 wherein the resulting solids content is less than the gel point of the storage pond tailings.

18. The method of claim 14 wherein the resulting solids content is less than 12 wt %.

19. The method of claim 1 wherein combining includes combining the heated tailings stream with the storage pond tailings in a volumetric ratio of 3:1 to 1:1.

20. The method of claim 1 wherein treating the tailings mixture includes froth treatment including flotation, froth cleaning and cleaned froth treatment to obtain bitumen.

21. The method of claim 1 further comprising collecting tailings from treating the tailings mixture and adding a flocculant to obtain thickened tailings or a centrifuge cake.

22. A method for recovering bitumen from fluid fine tailings, the method comprising:

a. combining the fluid fine tailings with hot froth treatment tailings in a volumetric ratio of 1:1 to 1:3 and adding recycle water to form a tailings mixture, the tailings mixture having a resulting solids content of less than 20 wt % and a resulting temperature of greater than 20° C.; and b. froth treating the tailings mixture by flotation, froth cleaning and cleaned froth treatment to obtain bitumen from the tailing mixture.

23. The method of claim 22 wherein the resulting solids content is less than the gel point of the fluid fine tailings.

24. The method of claim 22 wherein the resulting solids content is less than 12 wt %.

25. The method of claim 22 wherein the hot froth treatment tailings are from a solvent recovery unit.

26. The method of claim 22 wherein the hot froth treatment tailings have a temperature of 85 to 95° C. and a solids content of less than 25%.

27. The method of claim 22 wherein the resulting temperature is greater than 25° C.

28. The method of claim 22 wherein treating the tailings mixture includes froth treatment including flotation, froth cleaning and cleaned froth treatment to obtain bitumen.

29. The method of claim 22 further comprising collecting tailings from treating the tailings mixture and adding a flocculant to obtain thickened tailings or a centrifuge cake.

* * * * *